US006086417A

United States Patent [19]

Hsiao et al.

[11] Patent Number: 6,086,417

[45] Date of Patent: Jul. 11, 2000

[54] ELECTRICAL CONNECTOR WITH FASTENING DEVICE

[75] Inventors: Yu-San Hsiao; Li-Ming Po, both of Tu-Chen, Taiwan

[73] Assignee: Hon Hai Precision Ind. Co., Ltd., Taipei Hsien, Taiwan

[21] Appl. No.: 09/195,746

[22] Filed: Nov. 18, 1998

[51] Int. Cl.[7] ..... H01R 13/73

[52] U.S. Cl. ..... 439/567

[58] Field of Search ..... 439/567, 569–572

[56] References Cited

U.S. PATENT DOCUMENTS

| | | | |
|---|---|---|---|
| 5,074,807 | 12/1991 | Parmer | 439/567 |
| 5,154,634 | 10/1992 | Brown et al. | 439/567 |
| 5,336,111 | 8/1994 | Thrush et al. | 439/567 |
| 5,415,565 | 5/1995 | Mosquera | 439/567 |
| 5,551,891 | 9/1996 | Huss, Jr. | 439/567 |
| 5,827,089 | 10/1998 | Beck, Jr. | 439/567 |

*Primary Examiner*—Gary Paumen

[57] ABSTRACT

An electrical connector comprises an elongate insulative housing and three board locks. Each board lock comprises a main body, a cutout defined in the main body, engaging teeth formed on opposite inner surfaces of the cutout, and a pair of resilient legs extending downward from the main body. Slots are defined in the housing for receiving the corresponding board locks therein. Each slot is formed having tapered inner walls and an engaging projection extending downward from the housing into a center of the slot. When the board lock is inserted into the corresponding slot, the tapered inner walls of the slot will guide the cutout of the board lock toward the engaging projection thereby reducing the force required to insert the board lock into the slot. The engaging projection is shaped to fittingly engage with the engaging teeth formed on the board lock, thus, the board lock is firmly secured thereto.

8 Claims, 4 Drawing Sheets

ELECTRICAL CONNECTOR WITH FASTENING DEVICE

BACKGROUND OF THE INVENTION

1. Field of the Invention

The present invention relates to an electrical connector, and particularly to an electrical connector having a fastening device which can be easily inserted therein without causing any damage to a housing thereof.

2. The Prior Art

Electrical connectors are often directly mounted to a printed circuit board by means of fastening devices such as board locks. At least a pair of board locks is interferentially engaged with inner walls of slots defined in a bottom surface of a housing of the connector. Resilient legs extending beyond the bottom surface of the housing are received in holes defined in the printed circuit board whereby the connector is mounted thereto. The related prior art is disclosed in Taiwan Patent Application Nos. 80204998, 80211753, and 8-210551, and U.S. Pat. Nos. 4,907,987, 5,057,027, 5,074,807, 5,080,611, 5,135,412, 5,184,963, 5,411,404, and 5,547,385.

A conventional board lock 31 disclosed in U.S. Pat. No. 5,184,963 is shown in FIG. 4. The board lock. 31 is inserted into a slot 301 defined in a housing 30 of an electrical connector 3 to mount the connector 3 onto a printed circuit board (not shown). The board lock 31 includes a main body 311, a pair of protrusions 312 projecting outward from an upper portion of the main body 312, and a pair of resilient legs 313 forming barbs 314 thereon for engaging with a hole defined in the PCB. When the board lock 31 is inserted into the slot 301, the protrusions 312 thereof will slide along the surface of inner walls 302 of the slot 301 until reaching a reception area (not labeled) whereby the board lock 31 is retained in the slot 301. Since the board lock 31 is commonly made of metal and the housing 30 is made of plastic, the board lock 31 will scrape the inner walls 302 of the slot 301 thereby wearing away the inner walls 302 to a level indicated by worn inner walls 303 thereby reducing the retentive properties between the board lock 31 and the housing 30.

Hence, an improved fastening device is requisite to eliminate the above mentioned defects of current fastening devices.

SUMMARY OF THE INVENTION

Accordingly, an objective of the present invention is to provide an electrical connector having a fastening device which will not damage an inner surface of a slot of a housing of the connector into which the fastening device is inserted thereby ensuring proper retention between the fastening device and the housing Another objective of the present invention is to provide an electrical connector having a fastening device which can be inserted into a slot defined in a housing of the connector without requiring a significant insertion force thereby increasing manufacturing efficiency.

A further objective of the present invention is to provide an electrical connector having a housing defining tapered slots therein for respectively receiving fastening devices whereby when the fastening device is inserted into the corresponding slot, the fastening device is guided toward an engaging projection extending into a center of the slot and engaging teeth of the fastening device properly engage with corresponding features of the engaging projection which decreases the force required to insert the fastening device and prevents the fastening device from wearing away inner walls of the slot.

To fulfill the above mentioned objectives, according to a preferred embodiment of the present invention, an electrical connector comprises an elongate insulative housing and three board locks. Each board lock comprises a main body, a cutout defined in the main body and exposed to a top portion thereof, engaging teeth formed on opposite inner surfaces of the cutout, and a pair of resilient legs extending downward from the main body. Slots are defined in the housing for receiving the corresponding board locks therein. Each slot is formed having tapered inner walls and an engaging projection extending downward from the housing into a center of the slot. By this arrangement, when the board lock is inserted into the corresponding slot, the tapered inner walls of the slot will guide the cutout of the board lock toward the engaging projection thereby reducing the force required to insert the board lock into the slot. The engaging projection is shaped to fittingly engage with the engaging teeth formed on the board lock, thus, the board lock is fittingly engaged therewith.

These and additional objectives, features, and advantages of the present invention will become apparent after reading the following detailed description of the preferred embodiments of the invention taken in conjunction with the appended drawing figures.

DETAILED DESCRIPTION OF THE PREFERRED EMBODIMENT

Reference will now be made in detail to the preferred embodiment of the present invention.

Figure 1:
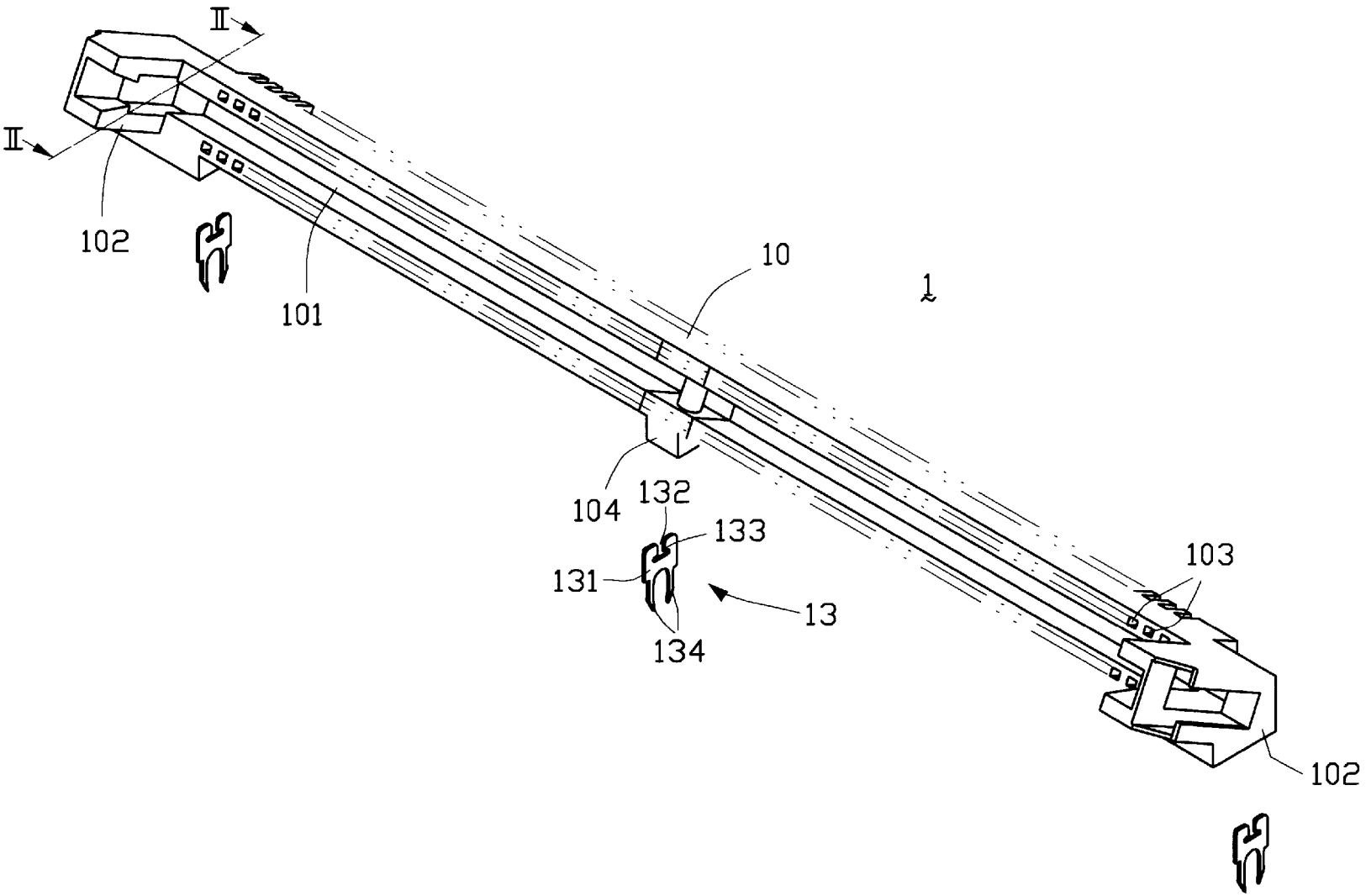
FIG. 1 is a perspective view of an electrical connector and board locks thereof in accordance with a preferred embodiment of the present invention.

Referring to FIG. 1, a DIMM connector 1 comprises an elongate insulative housing 10 and three board locks 13. The housing defines an elongate groove 101 in a front portion thereof for receiving a diagonally inserted card (not shown), and a plurality of contact receiving passageways 103. Three standoffs 104 are formed on a bottom surface of the housing 10 at end and central portions thereof for proximity to a printed circuit board (not shown). Side arms 102 are formed on transverse ends of the housing 10 for guiding the card into the connector 1. Each board lock 13 comprises a main body 131, a cutout 132 defined in the main body 131 and exposed to a top portion thereof, engaging teeth 133 formed on opposite inner surfaces of the cutout 132, and a pair of resilient legs 134 extending downward from the main body 131.

Figure 2:
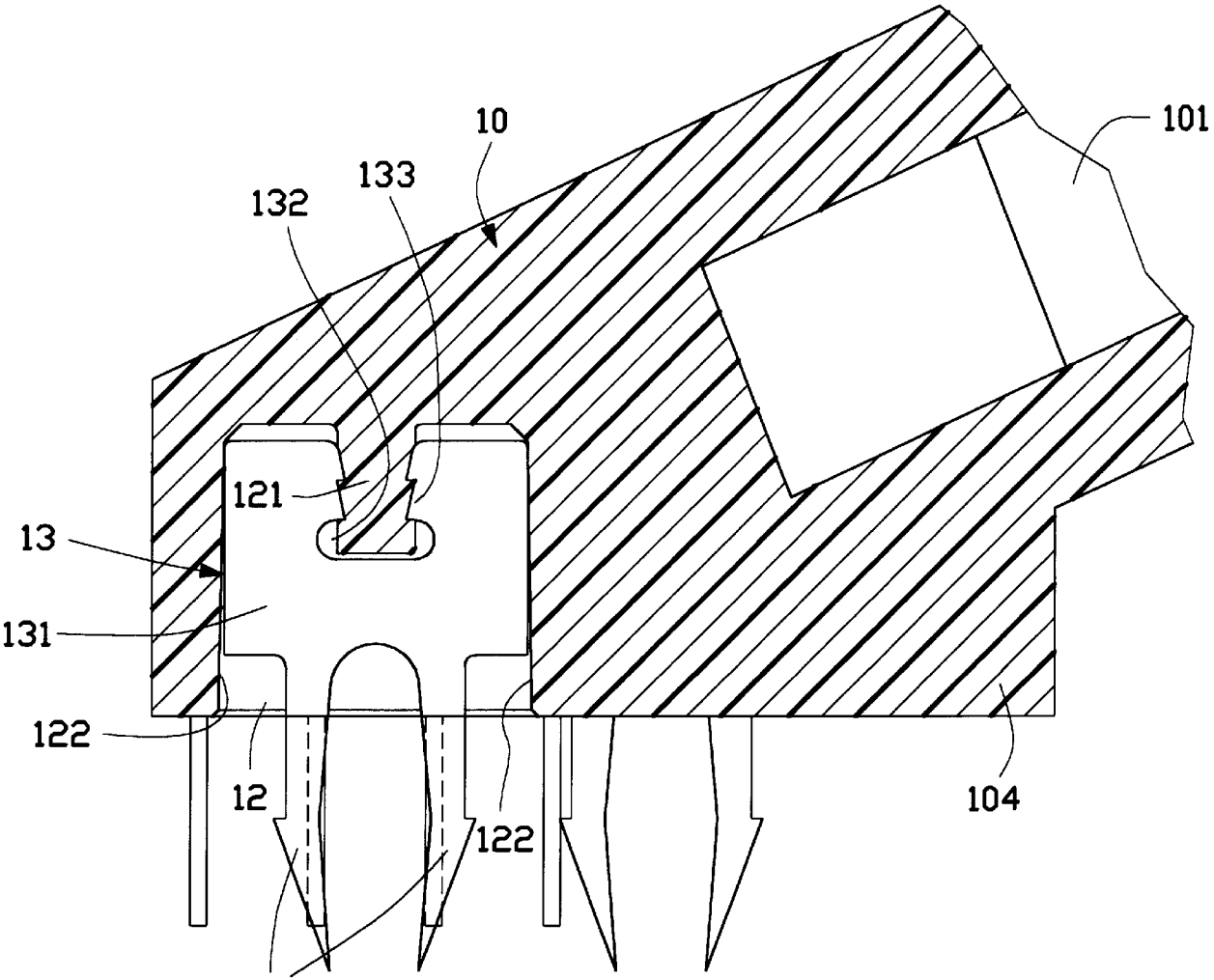
FIG. 2 is a cross sectional view of FIG. 1 taken along line II—II with the board locks engaged with the connector.

As shown in FIG. 2, slots 12 are defined in the standoffs 104 of the housing 10 for receiving the corresponding board locks 13 therein. Each slot 12 is formed having tapered inner walls 122 and an engaging projection 121 extending downward from the housing 10 into a central portion of the slot 12. By this arrangement, when the board lock 13 is inserted into the corresponding slot 12, the tapered inner walls 122 of the slot 12 will guide the cutout 132 of the board lock 13 toward the engaging projection 121 of the slot 12 thereby reducing the force required to insert the board lock 13 into the slot 12. The engaging projection 121 is shaped to fittingly engage with the engaging teeth 133 formed on the board lock 13, thus, the board lock 13 is firmly secured thereto.

Figure 3:
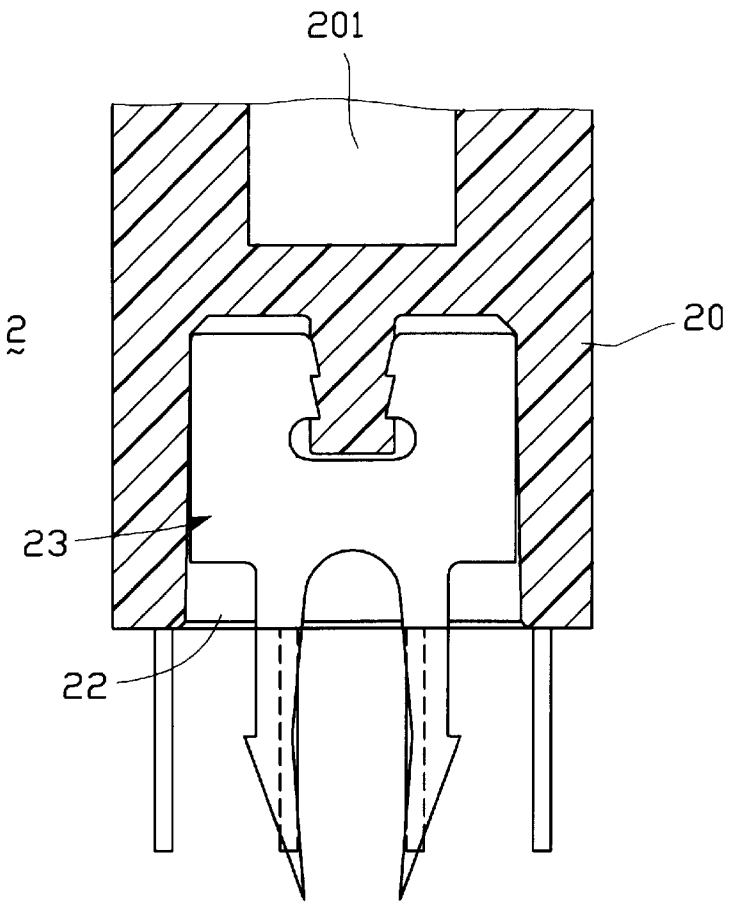
FIG. 3 is a cross sectional view of an electrical connector in accordance with a second embodiment of the present invention.
Figure 4:
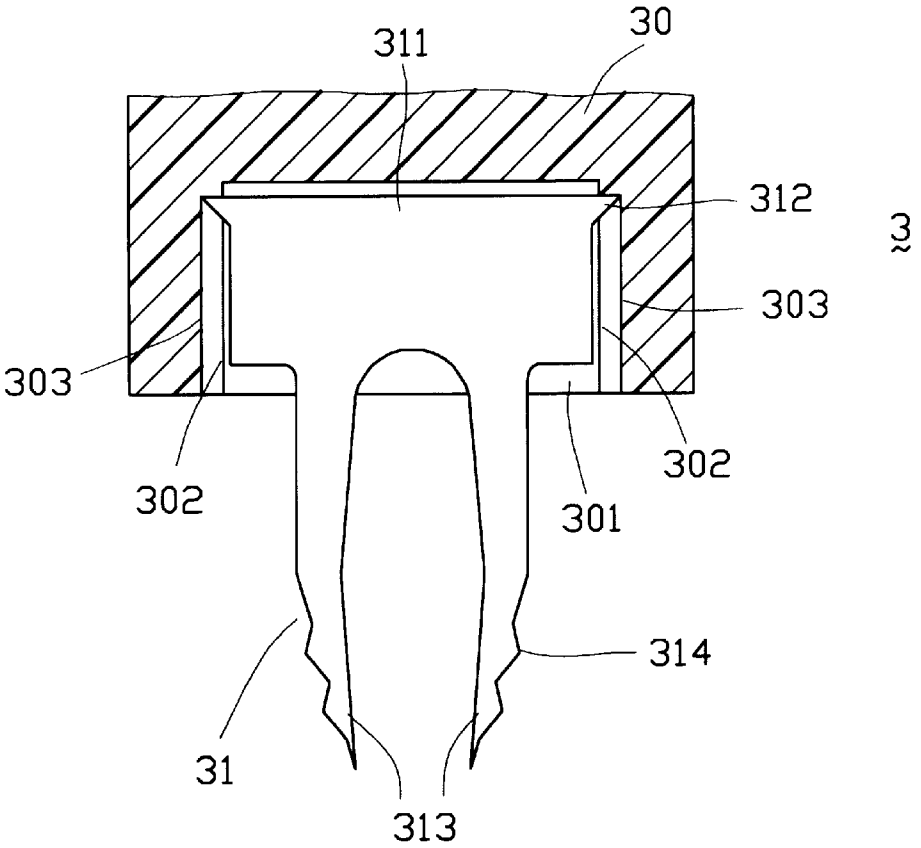
PRIOR ART FIG.4
FIG. 4 is a cross sectional view of a conventional board lock inserted into an electrical connector.

FIG. 3 shows an electrical connector 2 which defines a groove 201 for receiving a vertically inserted card (not shown) therein. A slot 22 defined in a bottom surface of a housing 20 and a board lock 23 received therein are identical to the slot 12 and board lock 13 of the first embodiment, respectively. Thus, detailed descriptions thereof are omitted here n.

One feature of the invention is to have the board lock 13 received within the slot 12 by two stages wherein at the first stage, the board lock 13 is partially installed to the housing 10 and the main body 131 of the board lock 13 enters the slot 12 in relatively loose manner by reason of tapered inner walls 122 of the slot 12; while at the second stage, the board lock 13 is fully installed to the housing 10 and the engaging projection 121 of the housing 10 fittingly engages with the engaging teeth 133 of the board lock 13 in a relatively tight manner.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. An electrical connector comprising:

an elongate insulative housing defining a plurality of passageways each receiving a conductive contact therein, and at least one slot having an engaging projection extending downward from the housing into a central portion of the slot; and a board lock received in each slot, each board lock comprising a main body, a cutout defined in the main body, and a pair of resilient legs extending downward from the main body for engaging with a hole defined in a printed circuit board;

whereby the engaging projection of the housing is shaped to fittingly engage with the cutout of the board lock for firmly securing the board lock in the housing; and wherein engaging teeth are formed on opposite inner surfaces of the cutout and on opposite sides of the engaging projection.

2. The connector as described in claim 1, wherein the slot is formed with tapered inner walls for guiding the cutout of the board lock toward the engaging projection of the slot thereby reducing the force required to insert the board lock into the slot.

3. The connector as described in claim 1, wherein at least a standoff is formed on a bottom surface of the housing for proximity to a printed circuit board.

4. The connector as described in claim 3, wherein the slots are defined in the standoffs from a bottom surface thereof.

5. The connector as described in claim 1, wherein the housing defines an elongate groove for receiving an inserted card.

6. The connector as described in claim 5, wherein side arms are formed on transverse ends of the housing for guiding the card into the connector.

7. An electrical connector for mounting on a circuit board, comprising:

an elongate insulative housing, and at least one slot having an engaging projection extending downwardly from the housing into a central portion of the slot; and a board lock received in each slot, each board lock comprising a main body, a cutout defined in the main body, and a pair of resilient legs extending downwardly from the main body for engaging with a hole defined in a printed circuit board;

whereby the engaging projection of the housing is shaped to fittingly engage with the cutout of the board lock for firmly securing the board lock in the housing, and wherein engaging teeth are formed on opposite inner surfaces of the cutout and on opposite sides of the engaging projection.

8. The fastening device as described in claim 7, wherein the cutout thereof is guided toward the engaging projection by means of tapered inner walls formed in the slot thereby reducing the force required to insert the securing device into the slot.

* * * * *